United States Patent [19]

Easter

[11] 3,934,790

[45] Jan. 27, 1976

[54] FARM PRODUCE CONTAINERS

[76] Inventor: Avard Joseph Easter, 1151 S. Walnut, La Habra, Calif. 90631

[22] Filed: May 24, 1974

[21] Appl. No.: 473,150

[52] U.S. Cl. ..... 229/23 R; 206/512; 229/15; 229/6 A

[51] Int. Cl.[2] ..... B65D 5/24; B65D 5/48

[58] Field of Search ..... 229/6 A, 15, 23, 17 B; 220/22

[56] References Cited

UNITED STATES PATENTS

| | | | |
|---|---|---|---|
| 1,782,915 | 11/1930 | Weidner | 229/15 |
| 1,826,197 | 10/1931 | Adams | 229/6 A |
| 1,860,567 | 5/1932 | Boeye | 229/15 |
| 2,032,799 | 3/1936 | Hagopian | 229/6 A |
| 2,073,635 | 3/1937 | Holoubek | 220/22 |
| 2,743,050 | 4/1956 | Crane | 229/15 |
| 2,809,775 | 10/1957 | White | 229/6 A |
| 2,944,696 | 7/1960 | Effgem | 220/22 |
| 3,048,318 | 8/1962 | Sabin | 229/15 |
| 3,713,579 | 1/1973 | Chaffers | 229/23 R |
| 3,721,386 | 3/1973 | Meyers | 229/15 |

*Primary Examiner*—Davis T. Moorhead
*Attorney, Agent, or Firm*—Grover A. Frater

[57] ABSTRACT

A special blank having cutouts at its side margins and a series of cutouts at its ends may be folded into a box having stiffening ribs in its bottom wall. That construction makes it especially useful as a box or tray for carrying produce, particularly when that produce is packed in standard berry boxes. Combined with a pair of end wall members, the folded blank provides a berry tray of the kind that will nest one in the other and is conveniently stacked in many-tiered stacks. The tray construction is such that it can withstand very high humidity environments, even when the construction material is corrugated paperboard. In the preferred form, the end members, or wall stiffeners, are formed of plural layers folded into a shape that is triangular in cross section so that the base of the triangle forms a shelf for supporting upper trays of a stack. One layer of the end member is notched to straddle the strengthening ribs. The other is not.

14 Claims, 12 Drawing Figures

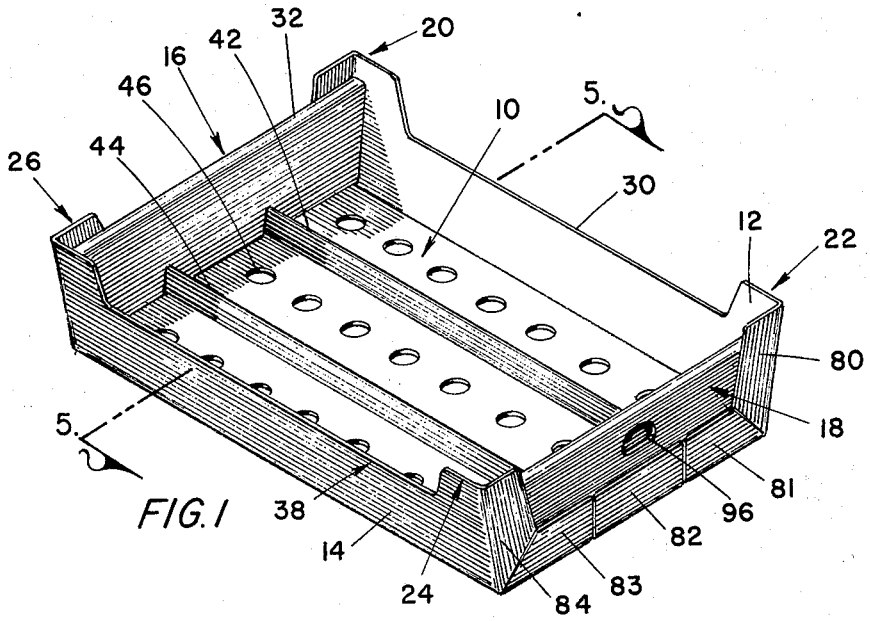
FIG. 1
FIG. 2
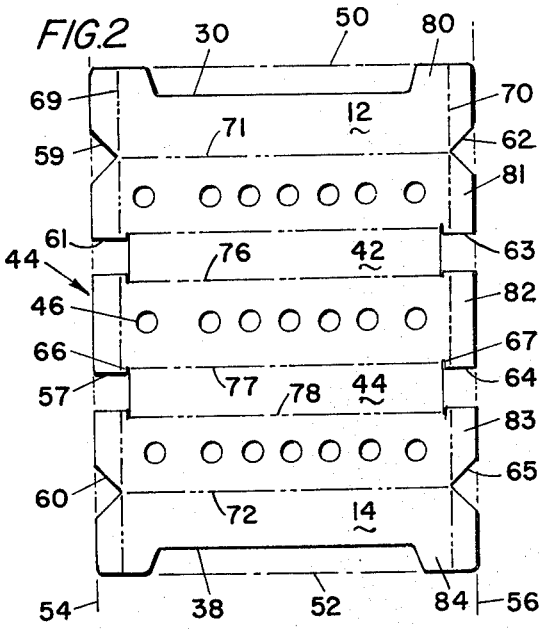
FIG. 3
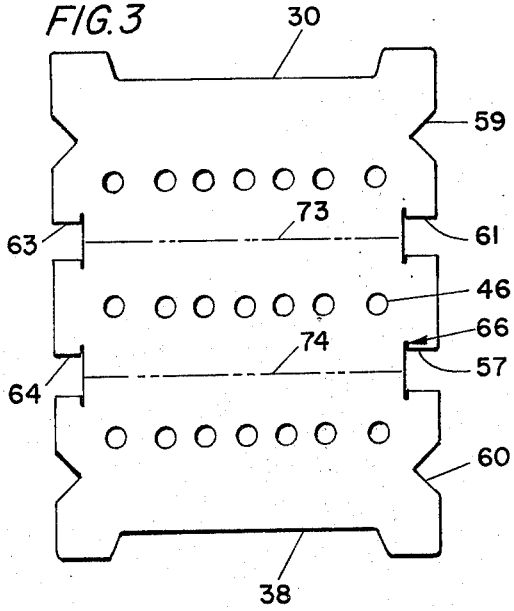
FIG. 6
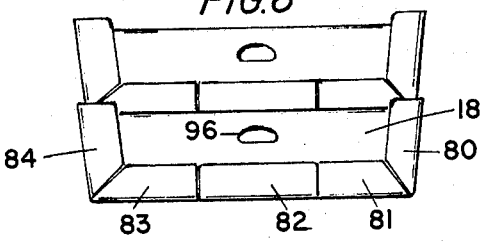
FIG. 4
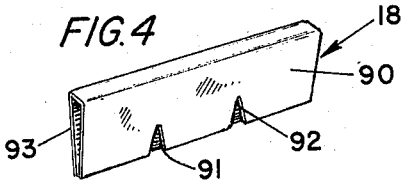
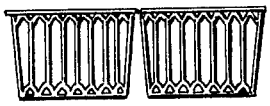
FIG. 7
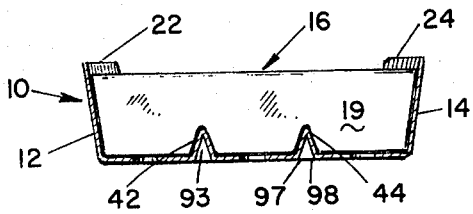
FIG. 5

FARM PRODUCE CONTAINERS

This invention relates to improvements in containers for farm produce. It relates particularly to a tray or "flat" of the kind that can withstand high humidity conditions when fabricated in whole or in part from corrugated paperboard.

BACKGROUND

It is not essential that trays made according to the invention be made of corrugated paperboard. However, it is an object of the invention to provide a produce tray which can be made of paper, and which will retain its shape and strength and will remain entirely functional despite being subjected to conditions of high humidity for protracted periods. Another object is to provide a tray which can serve as a carrying case for 1 dozen one-pint size berry baskets of standard shape in an overall size that is smaller than the size that has heretofore been available in corrugated paper trays.

The reduction in overall size is an important object of the invention. Industry standards and United States Department of Commerce standards require a produce container in which berries are to be transported that is capable of holding 12 pint sized boxes of berries. Such trays are available in physical forms that will withstand conditions of high humidity. However, the ability to withstand humidity is achieved at the expense of increased outer dimension. The dimensions were compatable with truck and rail transportation of berries, but they are not compatable with air transport standards. This invention provides a produce tray which is equal to, or superior to, prior boxes in function, and which has reduced overall dimensions so that a larger number of trays, an integral number of dozens of them, can be placed within a standard air freight container.

Another object of the invention is to provide a produce flat, or tray, which is suitable for cherries, brussel sprouts, cherry tomatoes, and other small produce items which may be packaged in baskets or shipped in bulk.

Another object of the invention is to provide a produce flat, or tray, which can be shipped in dissembled condition to save bulk and which can be quickly and easily assembled into final shape at the packing site.

SUMMARY OF THE INVENTION

Several important features are combined in the preferred embodiment of the invention to accomplish these several objectives. Among these features are ribs that extend the length of the bottom of the box to prevent sagging at the bottom notwithstanding the presence of substantial amounts of water and high humidity. Another feature is an end wall construction which permits formation of the ribs without loss of lateral strength by making folds in the bottom wall of the box or tray. Another feature is the provision of a blank from which the box may be created by folding and which results in the formation of corner angles which facilitate nesting while permitting a free flow of air through the box and over its contents. Another feature of the invention is that the bottom wall may be provided with a large number of perforations without detracting from the strength of the box or from its ability to withstand conditions of high humidity.

Another feature in the preferred embodiment is an end wall member which is folded to triangular shape.

The base, assembled inverted, serves as a shelf on which other trays may be stacked. One side is notched to straddle the ribs, the other is not.

These and other objects and advantages of the invention and other features of the invention will be apparent from an examination of the drawings and specification which follows.

IN THE DRAWINGS:

FIG. 1 is a pictorial view of a produce basket made according to the invention;

FIG. 2 is a plan view of a blank used in forming the box or tray, shown from the side that will become the interior of the box;

FIG. 3 is a plan view of the blank of FIG. 2 shown from the side that will become the outer side of the finished box;

FIG. 4 is a pictorial view of an end wall member shown from one edge and the side that will face toward the interior of the finished tray;

FIG. 5 is a cross sectional view taken on line 5—5 of FIG. 1;

FIG. 6 is a diagram illustrating how two boxes of the kind shown in FIG. 1 may be nested, one in the other;

FIG. 7 is a view in end elevation of a pair of one-pint berry baskets arranged side-by-side;

Figure 8:
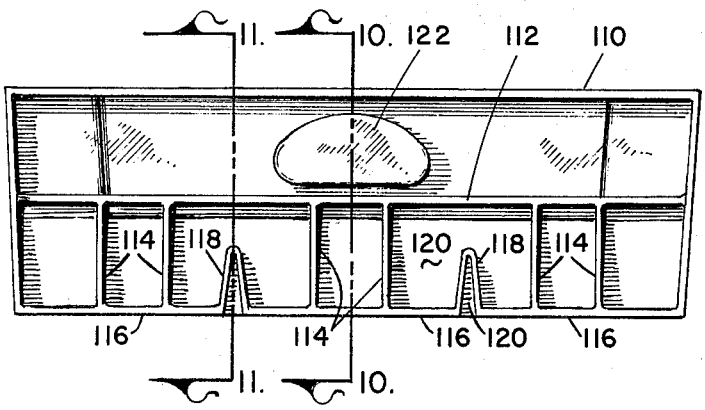
FIG. 8 is a view in elevation of an alternative form of end member shown from the side that faces the interior of the tray.

The tray of FIG. 1 is comprised of three pieces. One of them serves as the bottom wall and two of them serve as end walls in the finished product. Extensions of the material of the bottom wall at its ends are folded up and secured to the special end wall members and become part of the ends. In FIG. 1, the bottom wall of the inner side of the tray is visible together with the inner wall of one of the sides, at the upper right, and the inner wall at one of the ends, at the upper left in FIG. 1. Also visible are the exteriors of the other side and the outer wall of the other end at the lower left in FIG. 1 and the outer of the other end wall which is seen at the lower right in FIG. 1. For identification, the bottom wall is generally designated 10. The element 16 serves as part of one end wall and the element designated by the reference numeral 18 is part of the other end wall.

The tray is formed with four corner angles which are identified by the numerals: 20 at the junction of side 12 and end 16, 22 at the junction of side 12 and end 18, 24 at the junction of side 14 and end 18, and, finally, 26 is formed at the junction of side wall 14 and end wall 16. Part of wall 12 is cut away at 30 so that the upper margin of the wall, except at the corner angles, is lower than the upper margin or strip 32 that forms part of end wall 16. The other end wall member is formed to the same height so its upper margin or strip stands above the upper margin 30 of wall 12. Wall 14 is cut away in similar fashion at its upper edge so that its upper margin 38 stands at the same height as does the margin 30.

Two ribs may be seen in FIG. 1 extending up from the bottom wall 10 into the interior of the tray. One of those ribs is designated 42 and the other is designated 44. They are V-shaped in cross section with their apexes extending upwardly and they extend in the direction parallel to the sides of the tray. They are spaced so that the bottom of the tray is divided into three substantially equal areas that extend the length of the tray. The bottom is perforated by a number of air flow and water drain openings. One line of those openings preceeds lengthwise of the box on the center line of each of the three areas mentioned above. One of those perforations has been given the reference numeral 46 for identification.

In this embodiment, the tray is formed of three pieces of corrugated paperboard which ordinarily are shipped flat to the point of use where the corrugated board blanks are folded upon crease lines and are assembled and fastened together. Portions of the end of the blank that includes the bottom wall are secured by any convenient means, as by the use of an adhesive in the preferred form, to the members that comprise the bulk of the end walls.

The blank in FIG. 2 is formed from a flat piece of corrugated paperboard. The board is divided into several areas which are bounded by the outer construction line in some cases and by crease lines in other cases. A "crease line" is a line formed by indenting or piercing or lancing one side of the board so that the board will fold on that line in response to forces tending to bend the board. For identification, the construction line 50 is coincident with the upper edge of the board 48. The construction line 52 is coincident with its lower edge. The construction line 54 is coincident with its left end and the construction line 56 is coincident with its right end. The upper and lower edges of the board in FIG. 2 are mere images of one another and they are symmetrical about the vertical center line, not shown, through the board. The left end and the right end of the board are mirror images of one another and they are symmetrical about the lateral center line, not shown, through the board. A cutout is formed at each of the upper and lower edges of the board to form the margin 30 of one side wall and the margin 38 of the other side wall. The end of the board, the left end in FIG. 2, is formed with a V-shaped notch 59 near the upper edge and a V-shaped notch 60 near the lower edge. Between these two V-shaped notches, there is a rectangular notch 61 and a similar rectangular notch 62. Thus, the left end of the board 48 is formed with a V-shaped notch 59, a rectangular notch 61, a rectangular notch 57, and a V-shaped notch 60, in that order from the upper edge to the lower edge of the board. At the right end of the board there is a V-shaped notch 62 across from V-shaped notch 59. There are rectangular notches 63 and 64 across from rectangular notches 61 and 57, respectively. Finally, there is a V-shaped notch 65 across from the V-shaped notch 60. All of these V-shaped notches have the same size, and in this embodiment, the side walls of the notches are separated by a little less than 90°. All of the rectangular notches have the same size and shape. The apex of the V-shaped notches extend toward the interior of the board and they have a depth that is less than the depth of the rectangular notches by an amount which corresponds approximately to the thickness of the board.

In each case, the board is lanced through along a line beginning at the inner corners of the rectangular cutouts. Those lance lines extend parallel to construction lines 54 and 56 and they extend for a distance approximately equal to one half of the width of the base of ribs 42 and 44. There are eight of those lance lines, one proceeding from each of the inside corners of the rectangular notches. One of those lance lines is identified by the reference numeral 66 and another by the reference numeral 67.

There are ten crease lines. Two of them, numbered 69 and 70, respectively, extend parallel to the end margins of the blank. Crease line 69 extends through the apex of V-shaped notches 59 and 60. Crease line 70 extends through the apex of V-shaped notches 62 and 65.

There are eight crease lines that extend in the opposite direction, parallel to construction lines 50 and 52. A first one of these eight crease lines is designated 71 and it extends from the apex of notch 62 to the apex of notch 59. A second one of these eight crease lines is numbered 72. It extends from the apex of notch 60 to the apex of notch 65. The third and fourth ones of those crease lines are designated 73 and 74, respectively, and they are visible in FIG. 3. Crease line 73 extends from the mid-point across the width of notch 61 to the mid-point across the width of notch 63. The fourth crease line 74 extends from the mid-point across the width of notch 62 to the mid-point across the width of notch 64. The four remaining crease lines are visible in FIG. 2. Each one extends from the end of one of the lance lines at one end of the board to the end of the corresponding lance line at the other end of the board. Thus, lance lines 75 and 76 extend from the ends of the lance lines that are associated with notch 61 to the ends of the lance lines that are associated with notch 63. Crease line 77 extends from the end of lance line 66 to the end of the corresponding lance line 77 at the corner of notch 64. Finally, the crease line 78 extends from the end of the other lance line associated with notch 57 to the end of the other lance line associated with notch 64.

When the blank is folded, it is folded so that the crease is within the fold. The area bounded by crease lines 69, 70, 71 and construction line 50 is the side wall 12. The area bounded by construction line 52 and crease lines 69, 70 and 72 is the side wall 14. The area within crease line 75 and 76 is folded to become the rib 42 and the area between crease lines 77 and 78 is folded to become the rib 44. There are three more areas between the crease lines 69 and 70, and those areas form the bottom wall 10 of the tray. They include the perforations that are visible in FIG. 1, including the perforation 46.

The remaining areas of the blank 48 are folded so that they become part of the end walls of the tray. Area 80 is the one bounded by construction lines 50 and 56, crease line 70, and the margin of notch 62. Area 81 is that area of the blank which is bounded by construction line 56, crease line 70 and margins of notches 62 and 63. Area 82 is bounded by margins of notches 63 and 64, crease line 70 and construction line 56. Area 83 is bounded by margins of notches 64 and 65, construction line 56 and crease line 70. Finally, area 84 is that area which is bounded by construction line 52 and 56, crease line 70 and a margin of notch 65.

Since the angle at which the sides of notches 59, 60, 62 and 65 converge upon one another is less than 90°, the side walls do not stand vertically. Instead, they extend upwardly and outwardly from the bottom wall as best shown in FIG. 6 where the tray at the bottom is shown in FIG. 1.

The preferred form of the end wall member is shown in FIG. 1. The function of that member is not merely to serve as part of the enclosure. It serves to secure the ribs in folded condition, to provide a supporting surface for the tray that may be stacked above it, to provide a stiffening element, and to serve as a guide for assembly so that the assembled tray will have both the design shape and design dimensions. Its construction can be understood by examination of FIGS. 1, 4, 5 and 6.

The end wall member 18 is shown in pictorial view in FIG. 4. In this embodiment, it is made of corrugated paperboard which is provided with two crease lines that are formed by perforating the board at one side along two spaced, parallel lines that extend entirely across the member in the mid-region along its length. When the board is folded on those crease lines, the construction shown in FIG. 6 results. It is shown to include a double thickness of the corrugated board. The portion of the board between the two perforation lines serves as the support ledge. The side at the inner side of the tray is numbered 90. It is formed with two V-shaped notches that open at its lower edge. The notch 91 accomodates or straddles rib 42 in the finished construction as best shown in FIG. 5. The other V notch, 92, accomodates or straddles rib 44 when the tray is assembled. The outer wall 93 does not have the V notches. In the preferred form, wall 93 formed with a perforation at its upper central region which serves as a handhold. The handhold 96 is visible in FIGS. 1 and 6. In the completed construction the outer wall 93 fits between the end of the ribs and the end areas of the blank from which the base is formed (see FIG. 4). More particularly, the outer wall 93 fits snugly between the end of ribs 42 and 44 and portions 81, 82 and 83 of the blank 48. Part of wall 93 may be seen through the V-shaped ribs 42 and 44 in FIG. 5.

Not only do notches 91 and 92 hold the blank 48 folded so that the ribs 42 and 44 are formed, but they pinch the sides of those ribs together such that the opposed surfaces of notch 63 and the opposed surfaces of notch 64 are forced into abutment. As shown in FIGS. 1 and 6, the sides of the notches are forced into abuting relation or close to it. That feature is also seen in FIG. 5. In the space between the sides of the two V-shaped ridges, below the bottom edge of wall 93, a part of the bottom wall is visible. The surface that is formed by the lancing of the board at the corners of the rectangular notches 63 and 64 is exposed. Thus, the section of the bottom, numbered 97, and the section of the bottom numbered 98, are surfaces that are formed and made visible by the cut, or lance, at each side of the inner corner of notch 64 (see FIGS. 2 and 3). The depth of cut and the position of crease lines 77 and 78 is such that the sides of notch 64 are brought into abutment when the side walls of the rib 44 have exactly the desired angle, which, of course, is the same angle at which the sides of notch 92 are formed.

The rib is given a size and angle so that it will fit in the space between a pair of standard berry baskets. Two such berry baskets are shown in FIG. 7. They are arranged side-by-side with their upper edges touching. Their side walls slope inwardly and upwardly from the bottom wall so that the space between two baskets arranged side-by-side with their upper ends touching is V-shaped in cross section. The ribs 42 and 44 are formed so that they substantially fill that V-shaped space. That arrangement facilitates loading the tray with berry baskets and it will keep those berry baskets in proper position, notwithstanding rough handling of the tray.

The tray in this embodiment is arranged so that it will hold twelve berry baskets. They are arranged in three rows with four baskets in each row. The tray is very little wider than three baskets. Provision of the ledges at the top of the end members 16 and 18 makes the length of the tray somewhat greater than the length of the line of four berry baskets. However, the amount of that increase is small, and a basket made in the manner illustrated occupies substantially less space than does the tray that heretofore has enjoyed most commercial success.

It is possible to reduce the size of the tray even more by forming it of plastic, but to do that materially increases the volume occupied by given quantity of baskets. The advantage in using corrugated board is that it is relatively inexpensive, and it can be shipped flat for assembly at the job site. The advantage in shipping bulk more than offsets the need to complete assembly in most circumstances. A two-part contact adhesive, one part of which is applied to the blank of FIGS. 2 and 3, the other part of which is applied to the outer walls of end wall elements 16 and 18 makes assembly relatively simple and inexpensive. The use of that kind of adhesive is not mandatory and other fastening means may be employed.

While the end wall element shown in the drawings is preferred, it is possible, of course, to use an end wall element having a different shape and a different composition.

Figure 9:
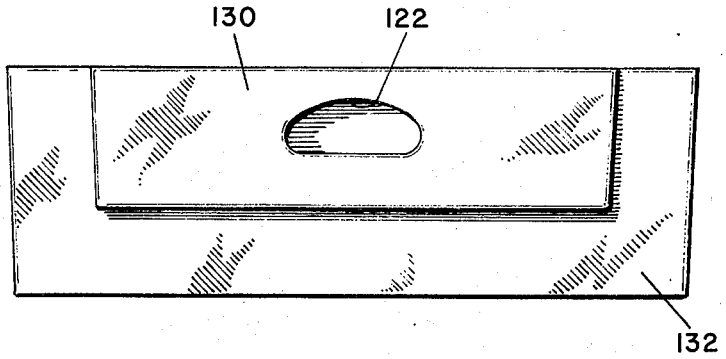
FIG. 9 is a view in elevation of an end member of FIG. 8 shown from the side that faces the exterior of the tray.
Figure 11:
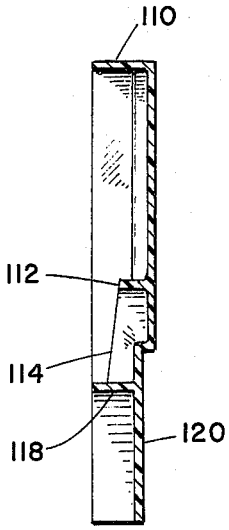
FIG. 11 is a cross sectional view taken on line 11—11 of FIG. 8.
Figure 10:
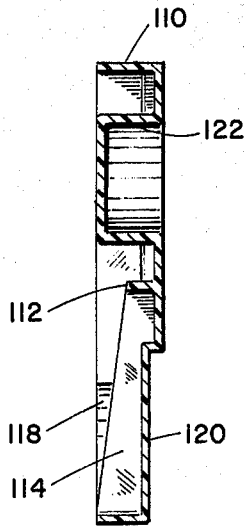
FIG. 10 is a cross sectional view taken on line 10—10 of FIG. 8.
Figure 12:
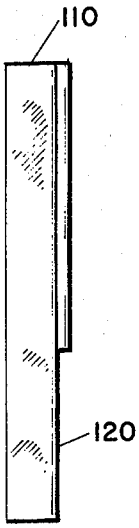
FIG. 12 is an end view of the end member shown in FIGS. 8 and 9 as it appears when looking from the right in FIG. 8 and from the left in FIG. 9.

One alternative form of end wall element is shown in FIG. 8 through 12. This one is designed for production in plastic by the injection molding process. The relatively thin wall is reinforced with ribs. The ribs extend toward the inside of the tray and are placed so that they provide additional functions. Conversely, the design may be thought of as one in which portions of the structure are cut away or are made thinner wherever greater thickness is not required whereby a substantial amount of material may be saved. The horizontal upper rib 110 serves as the ledge upon which another tray may be stacked. An elongated, horizontal rib 112 serves as a stop for the upper edge of berry baskets that may be placed within the tray. So that the berry boxes next to the end wall cannot be tilted, but must lie flat against the bottom of the tray, a number of vertical ribs 114 are provided. They extend from the transverse rib 112 vertically downward to the bottom rib 116. As best shown in FIGS. 10 and 11, those ribs become wider toward the bottom of the end member to conform generally to the shape of the sides of the berry boxes. The walls of the latter are tapered inwardly toward the botom of the box as best shown in FIG. 7.

In addition to the upper ledge 110, the alternate form shown in FIGS. 8 through 12 preserves two other important features of the end wall element shown in FIGS. 5 and 6. Part of the lower rib 116 is cut away at the point where the ribs of the tray engage the end element. V-shaped ribs 118 are formed at those points so that they extend inwardly from the wall 120 of the end member. The wall 120 is not cut through under the V-shaped rib 118. In the completed construction, the ribs 42 and 44 fit within the V-shaped rib 118 and the ends of the ribs 42 and 44 abut against the inner side of wall 120. As in the case of the corrugated board end member construction, this arrangement prevents moisture from entering the corrugated board through the ends of the ribs 42 and 44.

That kind of protection against moisture makes it possible to construct the blank shown in FIGS. 2 and 3 so that the corrugations are parallel to the eight crease lines that were described earlier. Standard practice would require that corrugations run the opposite way for greater strength in the side walls. However, the provision of the end ledges for supporting upper tiers of trays makes strength in the side walls less important.

Reference to FIGS. 1, 4 and 6 will show that the hand hold 96 does not extend entirely through the end wall member. That arrangement has two purposes. The primary reason for that construction is to prevent the handler's fingers from extending through into the interior of the tray where they might damage a berry and start the decomposition cycle. The plastic construction shown in FIGS. 8 through 12 preserves that same protective feature. The finger hold 122 does not extend entirely through the wall. An added reason for that construction in FIGS. 1 through 6 is that less moisture will enter the space between corrugations if the finger hold does not open into the interior of the tray where the amount of moisture is ordinarily greater than it is at the exterior of the tray. That problem is not presented in the plastic end member.

There is another feature of the plastic version of the end wall member that is important in protecting the corrugated board portions of the finished tray against accumulation of moisture. As best shown in FIGS. 9, 10, 11 and 12, the plastic version has portions of its outer wall offset from other portions. More particularly, the lower and side portions of the outer face of the end wall member are recessed back from the level of the upper inner portion of the outer surface of the end wall element. Referring to FIG. 9, the area 130 extends outwardly beyond the level of the area 130 by an amount that is approximately equal to the thickness of the corrugated board that will form the remainder of the tray. When the end portions of the corrugated blank are folded up and glued to the outer surface, area 132 of the end element, the cut edges of the blank will generally fit under the shoulder that is formed at the change in level in areas 130 and 132.

It is also possible to form those end wall sections in 16 and 18 integrally with the blank from which the bottom wall is formed. In that case, parts of areas 80, 81, 82, 83 and 84 would be omitted, and would be replaced by an extension of the blank. That same thing would be done on both sides. The form shown is the preferred form. However, the alternate form in which the end members 16 and 18 are integrally formed with the remainder of the blank is one of the alternatives that is possible within the invention.

Although I have shown and described certain specific embodiments of my invention, I am fully aware that many modifications thereof are possible. My invention, therefore, is not to be restricted except insofar as is necessitated by the prior art.

I claim:

1. A creased blank suitable for folding along its crease lines to form the longer side walls and the bottom wall of a rectangular container, said blank comprising;

a flat rectangularly shaped board of material capable of being creased to form crease lines and of being folded along said crease lines;

said blank having portions of both of its end edges and both of its side edges cut away;

the side edges being shaped as the mirror image of one another, each having an elongated cutout formed over a majority of the central region thereof;

said end edges being shaped symetrically about the mid-point along their length and shaped as the mirror image of one another; and said end edges being formed with four cutouts arranged in series along said edges, the outer most two of said cutouts being V-shaped.

2. The invention defined in claim 1 in which said end edges are formed with a V-shaped cutout, a rectangularly shaped cutout, another rectangularly shaped cutout, and another V-shaped cutout, in that order, the rectangular cutout extending to a greater depth in the board than do the V-shaped cutouts.

3. The invention defined in claim 1 in which said board is formed with two crease lines both extending parallel to said end edges and each extending at a distance from a respectively associated one of the edges substantially equal to the depth of said V-shaped cutouts;

said board further being formed with eight crease lines extending parallel to one another and to the side edges of said board, a first and second one of said eight creases extending between the apexes of respectively associated pairs of said V-shaped cutouts, and a third and fourth one of said eight creases extending between the mid-points along the width of pairs of the others of the cutouts formed in the end edges of said board, and a fifth and sixth one of said eight creases extending on opposite sides of, and equidistant from, said third crease, and the seventh and eighth ones of said eight creases extending on opposite sides of, and equidistant from said fourth crease.

4. The invention defined in claim 3 in which all of said creases other than said third and fourth creases are formed on one surface of said board, said third and fourth creases being formed on the opposite surface thereof.

5. The invention defined in claim 3 in which said board is formed with perforations in three areas of the board all lying between said first mentioned two crease lines, one of said areas lying between the first one of said eight crease lines bottom the next adjacent crease lines, the second one of said areas lying between the second one of said eight crease lines and the crease line next adjacent to it, and the third one of said areas lying between the two crease lines of said eight crease lines which are formed most closely to the mid-line between the side edges of said board.

6. The invention defined in claim 5 in which said board is lanced through in a direction parallel to the end edges of said blank for a distance at least equal to said thickness of said board from points beginning at each of the inner corners of said rectangular cutouts.

7. The invention defined in claim 6 in which said board comprises a corrugated paperboard whose corrugations extend parallel to the direction of said eight crease lines.

8. A tray for carrying produce comprising in combination:

a bottom wall having rectangular shape and bounded by side edges and end edges;

a pair of side walls extending upwardly and outwardly from respectively associated ones of the side edges of said bottom wall;

a pair of end walls extending upwardly and outwardly from respectively associated ones of the end edges of said bottom wall;

means in the form of cutouts in said side walls for providing upstanding nesting angles at the four corners formed by the junction of said end walls and said side walls;

means in the form of ledges extending inwardly from the end walls of said box at a level below the upper margin of said nesting angles and above the upper margins of the side walls in the regions of said cutouts; and stiffening means in the form of a rib fixed to the bottom wall of said tray and extending parallel to said side walls;

the upper margin of the rib lying in a plane parallel to and between the plane of the bottom wall and the plane containing said ledges.

9. The invention defined in claim 8 in which said double layers of sheet material are interconnected at their upper margins by a strip of said sheet material such that saidend wall is triangular in transverse cross section, said strip of sheet material forming said ledge.

10. The invention defined in claim 8 in which said bottom wall comprises a sheet material folded along lines extending across its width to form said ribs.

11. The invention defined in claim 10 in which said sheet material of which the bottom wall is comprised includes extensions at the end of the sheet, said extensions being folded against respectively associated end walls and forming a part thereof.

12. A tray for carrying produce comprising in combination:

a bottom wall having rectangular shape and bounded by side edges and end edges;

a pair of side walls extending upwardly and outwardly from respectively associated ones of the side edges of said bottom wall;

a pair of end walls extending upwardly and outwardly from respectively associated ones of the end edges of said bottom wall;

means in the form of cutouts in said side walls for providing upstanding nesting angles at the four corners formed by the junction of said end walls and said side walls;

means in the form of ledges extending inwardly from the end walls of said box at a level below the upper margin of said nesting angles and above the upper margins of the side walls in the regions of said cutouts; and stiffening means in the form of a pair of elongated ribs extending parallel to the side walls and spaced from one another and from said side walls and extending upwardly from said bottom;

said end walls having portions overlying the ends of said ribs and having other portions whose shape complements the shape of said ribs disposed to straddle said ribs and engage the sides thereof.

13. The invention defined in claim 12 in which said ribs are V-shaped in cross-section and fixed to the bottom wall apex up and in which the complementally formed portions of said end wall members comprise V-shaped recesses into which said ribs are disposed.

14. The invention defined in claim 13 which further comprises a finger hold formed in the exterior surface of said end wall member such that the recess does not open to the interior of said tray.

* * * * *